US005725178A

United States Patent [19]

Kewin

[11] Patent Number: 5,725,178

[45] Date of Patent: Mar. 10, 1998

[54] TUBULAR CORE ASSEMBLIES FOR ROLLS OF PAPER OR OTHER SHEET MATERIAL

[75] Inventor: Daniel Kewin, Brantford, Canada

[73] Assignee: 927246 Ontario Inc., Brantford, Canada

[21] Appl. No.: 778,592

[22] Filed: Jan. 3, 1997

Related U.S. Application Data

[63] Continuation of Ser. No. 541,281, Oct. 12, 1995, Pat. No. 5,595,356.

[51] Int. Cl.[6] ..... B65H 75/50

[52] U.S. Cl. ..... 242/613.5; 242/611.2

[58] Field of Search ..... 242/611.2, 612, 242/613, 613.4, 613.5

[56] References Cited

U.S. PATENT DOCUMENTS

| | | | |
|---|---|---|---|
| 1,241,193 | 9/1917 | Carlino et al. | 242/611.2 |
| 1,941,495 | 1/1934 | Schoultheis | 242/613.5 |
| 1,947,032 | 2/1934 | Bebie | 242/613.5 |
| 2,076,870 | 4/1937 | Taylor | 242/611.2 |
| 2,265,074 | 12/1941 | Kirilo | 242/611.2 |
| 3,083,928 | 4/1963 | Voissem | 242/613.5 |
| 3,291,413 | 12/1966 | Cushing et al. | 242/613.5 |
| 3,713,601 | 1/1973 | Buhrman et al. | 242/613.5 |
| 4,858,762 | 8/1989 | Kewin | 206/414 |
| 4,874,139 | 10/1989 | Kewin | 242/613.5 |
| 4,875,636 | 10/1989 | Kewin | 242/613.5 |
| 5,236,141 | 8/1993 | Kewin | 242/613.5 |
| 5,340,050 | 8/1994 | Renck | 242/609.1 |
| 5,356,093 | 10/1994 | Kewin | 242/610.4 |
| 5,366,085 | 11/1994 | Kewin | 206/407 |
| 5,393,010 | 2/1995 | Renck | 242/613.5 |
| 5,469,619 | 11/1995 | Renck | 242/613.5 |
| 5,595,356 | 1/1997 | Kewin | 242/613.5 |
| 5,597,135 | 1/1997 | Vandersteene | 242/559.4 |
| 5,615,845 | 4/1997 | Kewin | 242/615.3 |

FOREIGN PATENT DOCUMENTS

| | | | |
|---|---|---|---|
| 1 238 302 | 4/1967 | Germany | 242/613.5 |

*Primary Examiner*—John P. Darling
*Attorney, Agent, or Firm*—Rogers & Scott

[57] ABSTRACT

A tubular core assembly for a roll of paper or other sheet material has a hollow cylindrical core member formed of paperboard material, and an annular end member of metal or plastic material within each opposite end portion of the core member. Each end member has an outer annular surface to the inner annular surface of the core member and an inner annular surface shaped to receive a roll supporting chuck. Each end member also has a pair of radially-projecting lugs at diametrically opposite positions at the respective end of the tubular core assembly, the core member has a pair of lug-receiving notches at diametrically opposite positions at each end receiving the lugs of the respective end member to facilitate transmission of torque and axial chuck pressure from the end member to the core member. Each end member further has as pair of notches at diametrically opposite positions extending inwardly from the respective end of the tubular core assembly for receiving a projection of a roll supporting chuck, each projection-receiving notch being located circumferentially mid-way between the pair of lugs.

8 Claims, 1 Drawing Sheet

TUBULAR CORE ASSEMBLIES FOR ROLLS OF PAPER OR OTHER SHEET MATERIAL

Figure 1:
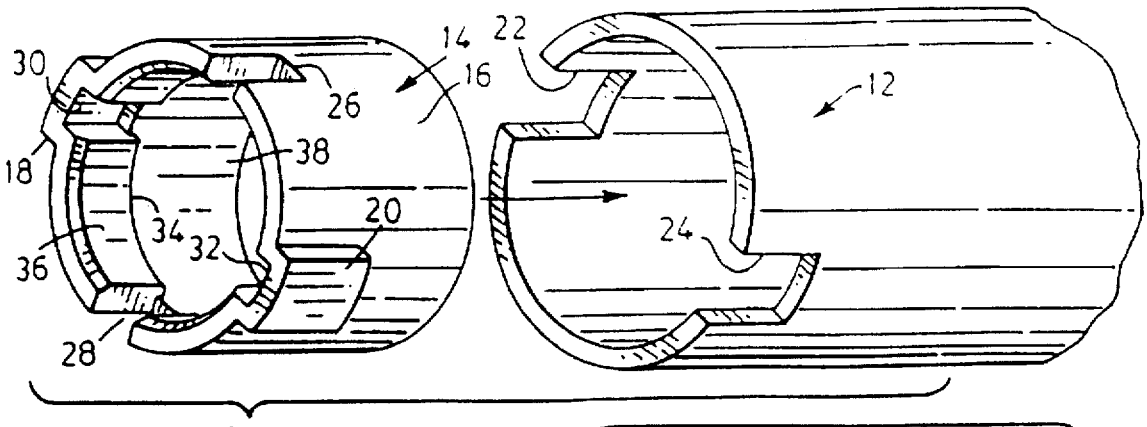

This application is a continuation of application Ser. No. 08/541,281 filed Oct. 12, 1995, now U.S. Pat. No. 5,595,356.

This invention relates to tubular core assemblies for rolls of paper or other sheet material.

U.S. Pat. No. 5,236,141 issued Aug. 17, 1993 describes (see FIGS. 6 to 8) a tubular core assembly which has a hollow cylindrical core member of paperboard material, and an annular end member of metal or plastic material within each opposite end portion of the core member. Each annular end member has an outer annular surface secured to the inner annular surface of the core member and an inner annular surface shaped to receive a roll supporting chuck. Each end member also has a pair of radially-projecting lugs at diametrically opposite positions at the respective end of the tubular core assembly and the core member has a pair of lug-receiving notches at diametrically opposite positions at each end receiving the lugs of the respective end member to facilitate transmission of torque and axial chuck pressure from the end member to the core member. Each end member further has a notch extending inwardly from the respective end of the tubular core assembly for receiving a projection on a roll supporting chuck, the projection receiving notch being located circumferentially mid-way between the pair of lug-receiving notches. The contents of said U.S. patent are hereby incorporated herein by reference.

The end members of such tubular core assemblies can be readily separated without damage from the core member after use. The end members can thus be reused and the core member can be recycled, for example by crushing and repulping. Further, not only can the parts of such a tubular core assembly be readily reused or recycled, but also the tubular core assembly combines the advantages of a relatively thin walled core member with the strength of a metal or plastic end member which is sufficient to withstand extreme transit impact without the support of an end plug. The ready separability of the end members also enables them to be replaced before roll installation in a reel if they should have become damaged during transit from the paper roll manufacturer or during mounting on the stub chucks of the reel.

Tubular core assemblies of the kind referred to above have proved to be successful both in paper production mills where paper is wound onto the tubular core assembly and in the printing industry where paper is unwound and fed to printing presses. However, practical use in the printing industry has highlighted some problems which are encountered not only by such tubular core assemblies but also by other types of tubular core assemblies.

There are various different kinds of roll mounting chucks currently in use in the printing industry. Some chucks have a single key which engage in a notch in the tubular core assembly, some chucks have radially movable portions which are movable radially outwardly to engage the inner surface of the tubular core assembly, and other chucks are moved under axial pressure into engagement with the ends of the tubular core assembly. A typical press room may have printing presses with different types of chucks. Thus, ideally, a tubular core assembly should be capable of use with such different types of chucks. Also, they should be user friendly, i.e. relatively easy for an operator to correctly engage the chucks with the tubular core assembly of a new paper roll. New and therefore fully wound paper rolls may have a weight of about 3,000 pounds, a length of about 5 feet, and a diameter of about 4 feet, and are not easily manoeuvred.

One of the practical difficulties encountered by a press room operator, when installing a new paper roll on single keyed chucks at an unwinding station, appears when the ends of the tubular core assembly of the roll have a single key receiving notch as is the case with conventional paper mill cores. When the new roll is moved into position, there is at least a fifty-fifty chance that the notch at the key receiving end of the tubular core assembly will be in the lower half of the roll, and hence not readily visible to the operator who has to align the chuck key with the notch at the end of the roll before the chucks are engaged therewith. Misalignment between a chuck key and a notch in an end of the tubular core assembly can cause serious damage to the tubular core assembly with the result that the roll may not be able to be used, or may have to be run at reduced speeds. The resultant waste of time and financial loss is self-evident.

It is therefore an object of the invention to provide a tubular core assembly which minimizes the problems referred to above.

According to the invention, each end member has a pair of radially-projecting lugs at diametrically opposite positions for engagement in lug receiving notches in the core member, and a pair of notches at diametrically opposite positions for receiving a projection of a roll supporting chuck, the projection receiving notches being located circumferentially mid-way between the pair of lugs.

Thus, one of the projection-receiving notches, i.e. chuck key receiving notches, will always be in the top half of the roll, therefore being readily visible to a press room operator installing a new roll at an unwinding station and substantially eliminating the risk of misalignment between the chuck key and the notch during the installation operation.

Each end member may have a further pair of projection-receiving notches, the further pair of projection-receiving notches extending inwardly from the respective end of the tubular core assembly immediately radially inwardly of a respective lug. Thus, when installing a new paper roll at an unwinding station with chucks which have a single key, the likelihood of a projection-receiving notch being in an optimum position for installation is significantly increased.

Another problem encountered in some press rooms is that, although different production lines may have unwinding stations equipped with chucks having keys, the chuck keys at one installation may have a different width from those at another station. For example, in Canada and United States, some chuck keys have a circumferential width of 9/16 inches and some have a circumferential width of 11/16 inches. It has become common practice therefore for conventional tubular core assemblies to have a single projection receiving notch at each end with a width of 12/16 inches, i.e. ¾ inches, to accommodate both key sizes. If however, when a chuck key having a circumferential width of 9/16 inches used with such conventional tubular core assembly, the resultant play between the chuck key and the notch results in excessive cyclical impacts between the key and the sides of the notch with each unwinding revolution, and an undesirable flutter is produced along the length of the unwound paper web. This can cause problems in the printing process, for example misalignment of different colours and other printed information. Since a full roll may rotate at about 150 r.p.m. and a nearly empty roll at about 1500 r.p.m., it can be appreciated that such excessive play between the chuck key and the notch in the tubular core assembly can cause serious problems during the printing run.

According to a further aspect of the invention therefore, the first mentioned pair of notches in the end member each have a different width from the further pair of notches within the lugs, for example a larger width for chucks with larger width keys and a smaller width for smaller width chuck keys. In practice, the different widths will be clearly indicated so that the operator will readily see which pair of notches are to be used for particular chuck keys. The problem of flutter previously described will therefore be substantially eliminated.

According to a further feature of the invention, each end member may also have a further pair of radially-projecting lugs each located immediately radially outwardly of a respective one of the first mentioned pair of notches, and the core member has a further pair of lug-receiving notches at diametrically opposite positions at each end receiving the further lugs of the respective end member. Thus, the engagement of each end member with the core member is further enhanced.

The inner surface of each member may have a rearwardly facing annular shoulder at the junction of a forward portion of smaller inner diameter and a rear portion of larger inner diameter. The presence of such a shoulder facilitates removal of an end member by engagement of a removal tool with the shoulder. Also, the forward part of the end member has a somewhat greater radial thickness which provides greater strength in the area of the lugs and the notches. The junction may conveniently be aligned with the inner ends of the notches.

Figure 2:
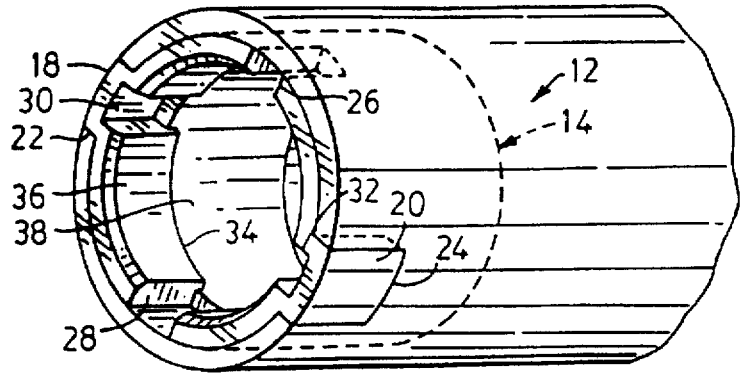
Figure 3:
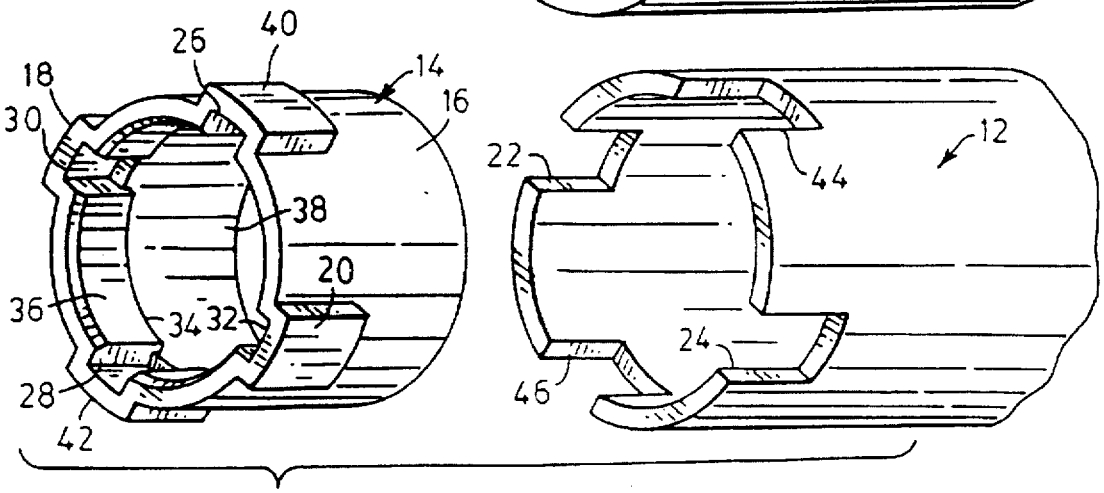
Figure 4:
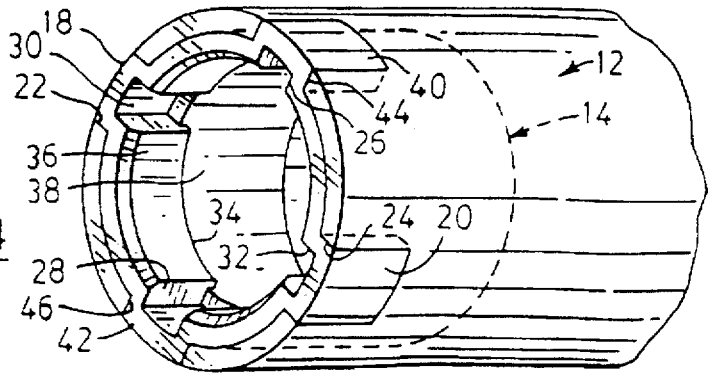

Embodiments of the invention will now be described, by way of example, with reference to the accompanying drawings, of which:

FIG. 1 is an exploded view of one end portion of a tubular core assembly in accordance with the invention, FIG. 2 is a perspective view of the tubular core assembly of FIG. 1 in an assembled condition, FIG. 3 is an exploded view of one end portion of a tubular core assembly in accordance with a second embodiment, and FIG. 4 is a perspective view of the tubular core assembly of FIG. 3 in an assembled condition.

Referring to the drawings, FIGS. 1 and 2 show one end portion of a tubular core assembly for a paper roll which comprises a hollow cylindrical core member 12 of paperboard material, and an annular end member 14 of synthetic plastic material with a sleeve portion 16 within each opposite end portion of the core member 12. The synthetic plastic material may for example be injection moulding grade 25% glass filled nylon type 6.

The sleeve portion 16 of each end member 14 has an outer annular surface which is a compression fit, i.e. a friction fit, in a respective end portion of the core member 12. Each end member 14 has a pair of lugs 18, 20 of rectangular section projecting radially outwardly at diametrically opposite positions from the end of the sleeve portion 16 at the end of the core member 12. The lugs 18, 20 are located in notches 22, 24 of rectangular section at corresponding positions in the ends of the core member 12. The lugs 18, 20 facilitate the transmission of torque and axial pressure from the plastic end members 14 to the core member 12 and, because of their diametrically opposite positions, provide dynamic balancing during rotation of the tubular core assembly.

The sleeve portion 16 of each end member 14 has a pair of diametrically opposite notches 26, 28 of rectangular section extending inwardly from an end thereof at positions circumferentially midway between the lugs 18, 20 to receive a projection on a roll supporting chuck. Each plastic end member 14 also has a further pair of notches 30, 32 which extend inwardly from the end thereof immediately radially inwardly of a respective lug 18, 20.

The inner surface of the sleeve portion 16 has a rearwardly facing annular shoulder 34 where the diameter of the inner surface increases from a smaller diameter front portion 36 to a larger diameter rear portion 38. The shoulder 34 is located in alignment with the inner ends of the notches 26, 28 and 30, 32. It will be noted that, in this embodiment, the lugs 18, 20 are slightly longer than the notches 26, 28 and 30, 32.

The lugs 18, 20 have a circumferential width in the range of from about 0.75 to about 3 inches, a radial height above the outer surface of the sleeve portion 16 in the range of from about 0.2 to about 1 inch, and a longitudinal length in the range of from about 0.5 to about 4 inches. The radial height of shoulder 34 is in the range of from about 0.075 to about 0.25 inches. It will noted that the notches 30, 32 have a radial height slightly greater than the wall thickness of the sleeve portion 16, i.e. extend slightly into the lugs 18, 20, to accommodate the greater height of the wider key.

The notches 26, 28 have a circumferential width in the range of from about 0.25 to about 1 inch, more preferably from about 0.375 to about 0.625 inches and a longitudinal length in the range of from about 0.5 to about 4 inches, more preferably from about 0.75 to about 1.5 inches. The notches 30, 32 have similar width and length ranges.

The ratio of end member wall thickness to core member wall thickness in the range of from about 0.75:1 to about 1.5:1. The sleeve portion 16 of each end member 14 has an internal diameter in the range of from about 3 to about 6 inches and an outer diameter in the range of from about 3.5 to about 7 inches. The core member 12 has an outer diameter in the range of from about 4 to about 9 inches. Each end member has a length in the range of from about 1.5 to about 6 inches, and the core member has a length in the range of from about 2 to about 10 feet.

In a specific example of the invention, the ratio of end member wall thickness to core member thickness is 1.15:1. The sleeve portion 16 of each end member 14 has an internal diameter of 3 inches, an external diameter of 3.75 inches and a length of 3 inches. The core member 12 has an outer diameter of 4.4 inches and a length of 4.5 feet.

The circumferential width of each notch 26, 28 is 10/16 inches and the circumferential width of each notch 30, 32 is 13/16 inches. Each of the notches 26, 28 can be used with a chuck key having a width of 9/16 inches, depending on which of these notches is in the most clearly visible position when a new roll is being installed at an unwinding station. Similarly, each of the notches 30, 32 can be used with a chuck key having a width of 11/16 inches. Which pair of notches is the wider and which pair is the narrower will be dearly indicated. Thus, the previously described problems which can occur when installing a new roll at an unwinding station are substantially eliminated.

FIGS. 3 and 4 show a further embodiment which is the same as the previously described embodiment, except that each end member 14 has a further pair of radially-projecting lugs 40, 42 each located immediately radially outwardly of notches 26, 28 respectively, and the core member 12 has a further pair of lug-receiving notches 44, 46 at diametrically opposite positions each receiving a respective lug 40, 42. The lugs 40, 42 of each end member 14 are the same size as the lugs 18, 20, and the notches 44, 46 in the core member 12 are the same size as the notches 22, 24. The additional force transmittal capability of such an arrangement will be self evident.

A further advantage of plastic end members is that the sleeve portion provides a recoverable and reusable carrier for RF/ID roll tags to replace current labels and bar codes which are subject to dirt and abrasion during transport, thus becoming unreadable.

Other embodiments of the invention will be readily apparent to a person skilled in the art, the scope of the invention being defined in the appended claims.

I claim:

1. A tubular core assembly for a roll of paper or other sheet material comprising:

a hollow cylindrical core member formed of paperboard material, and an annular end member of plastic material within each opposite end portion of the core member, each end member having an outer annular surface secured to the inner annular surface of the core member and an inner annular surface shaped to receive a roll supporting chuck, each end member having a radial thickness between said inner and outer annular surfaces thereof relative to the thickness of the core member in the range of from about 0.75:1 to about 1.5:1, each end member having a lug at the respective end of the tubular core assembly, said core member having a lug-receiving notch at each end receiving said lug of the respective end member to facilitate transmission of torque and axial chuck pressure from the end member to the core member, each annular end member having a notch for receiving a projection of a roll supporting chuck, said notch extending inwardly from the respective end of the tubular core assembly immediately radially inwardly of the lug, and each end member also having a further notch for receiving a projection of a roll supporting chuck, said further notch being located diametrically opposite the first mentioned notch.

2. A tubular core assembly according to claim 1 wherein each end member also has a further lug diametrically opposite the first mentioned lug, said further notch extending inwardly from the respective end of the tubular core assembly immediately radially inwardly of said further lug, and the core member having a further notch diametrically opposite the first mentioned notch at each end receiving said further lug of the respective end member to facilitate transmission of torque and axial chuck pressure from the end member to the core member.

3. A tubular core assembly according to claim 1 wherein each end member has an internal diameter in the range of from about 3 to about 6 inches, an outer diameter in the range of from about 3.5 to about 7 inches, and a length in the range of from about 1.5 to about 6 inches, said lug having a height above the outer annular surface in the range of from about 0.2 to about 1 inch, a circumferential width in the range of from about 0.75 to about 3 inches and an axial length in the range of from about 0.5 to about 4 inches, and said notch having a circumferential width in the range of from about 0.25 to about 1 inch and an axial length in the range of from about 0.5 to about 4 inches.

4. A tubular core assembly for a roll of paper or other sheet material comprising:

a hollow cylindrical core member formed of paperboard material, and an annular end member of plastic material within each opposite end portion of the core member, each end member having an outer annular surface secured to the inner annular surface of the core member and an inner annular surface shaped to receive a roll supporting chuck, each end member having a radial thickness between said inner and outer annular surfaces thereof relative to the thickness of the core member in the range of from about 0.75:1 to about 1.5:1, each end member having a lug at the respective end of the tubular core assembly, said core member having a lug receiving notch at each end receiving said lug of the respective end member to facilitate transmission of torque and axial chuck pressure from the end member to the core member, each annular end member having a notch for receiving a projection of a roll supporting chuck, said notch extending inwardly from the respective end of tubular core assembly immediately radially inwardly of the lug, and each end member also having a further lug diametrically opposite the first mentioned lug, and the core member having a further lug-receiving notch diametrically opposite the first mentioned notch at each end receiving said further lug of the respective end member to facilitate transmission of torque and axial chuck pressure from the end member to the core member.

5. An annular end member of plastic material for insertion into an end portion of a hollow cylindrical core member of a tubular core assembly for a roll of paper or other sheet material, said end member having an outer annular surface securable to an inner annular surface of a core member and an inner annular surface shaped to receive a roll supporting chuck, a radially-projecting lug adjacent an end thereof engageable in a lug-receiving notch in a core member, and a notch extending inwardly from said end for receiving a projection of a roll supporting chuck, said projection-receiving notch being located immediately radially inwardly of the lug, and also having a further notch for receiving a projection of a roll supporting chuck, said further notch being located diametrically opposite the first mentioned notch.

6. An annular end member according to claim 5 also having a further lug diametrically opposite the first mentioned lug and engageable in a further lug receiving notch in a core member, said further notch extending inwardly from said end immediately radially inwardly of said further lug.

7. An annular end member according to claim 5 wherein said end member has an internal diameter in the range of from about 3 to about 6 inches, an outer diameter in the range of from about 3.5 to about 7 inches, and a length in the range of from about 1.5 to about 6 inches, said lug has a height above the other annular surface in the range of from about 0.2 to about 1 inch, a circumferential width in the range of from about 0.75 to about 3 inches and an axial length in the range of from about 0.5 to about 4 inches, and each notch has a circumferential width in the range of from about 0.25 to about 1 inch and an axial length in the range of from about 0.5 to about 4 inches.

8. An annular end member for insertion into an end portion of a hollow cylindrical core member of a tubular core assembly for a roll of paper or other sheet material, said end member having an outer annular surface securable to an inner annular surface of a core member and an inner annular surface shaped to receive a roll supporting chuck, a radially-projecting lug adjacent an end thereof engageable in a lug-receiving notch in a core member, and a notch extending inwardly from said end for receiving a projection of a roll supporting chuck, said projection-receiving notch being located immediately radially inwardly of the lug and also having a further lug diametrically opposite the first mentioned lug engageable in a further lug receiving notch in a core member.

* * * * *